US008375761B2

(12) United States Patent
Wittig

(10) Patent No.: US 8,375,761 B2
(45) Date of Patent: Feb. 19, 2013

(54) METHOD FOR PRODUCING AN INTERNALLY OR EXTERNALLY TOOTHED CUP-SHAPED SHEET MATERIAL COMPONENT AND CORRESPONDING DEVICE

(75) Inventor: Axel Norbert Wittig, Wangen (DE)

(73) Assignee: Webo Werkzeugbau Oberschwaben GmbH, Amtzell (DE)

( * ) Notice: Subject to any disclaimer, the term of this patent is extended or adjusted under 35 U.S.C. 154(b) by 0 days.

(21) Appl. No.: 12/899,420

(22) Filed: Oct. 6, 2010

(65) Prior Publication Data

US 2011/0079066 A1 Apr. 7, 2011

Related U.S. Application Data

(63) Continuation of application No. PCT/DE2009/000463, filed on Mar. 31, 2009.

(30) Foreign Application Priority Data

Apr. 6, 2008 (DE) ..... 10 2008 017 608

(51) Int. Cl.
*B21D 9/08* (2006.01)
*B21D 17/00* (2006.01)
*B21B 17/10* (2006.01)

(52) U.S. Cl. ..... 72/213; 72/370.21; 72/208

(58) Field of Classification Search ..... 72/212, 72/213, 207, 208, 209, 370.21, 452.8, 452.9, 72/402, 102, 107, 121; 29/893, 893.32, 893.34
See application file for complete search history.

(56) References Cited

U.S. PATENT DOCUMENTS

| | | | | |
|---|---|---|---|---|
| 3,729,970 | A * | 5/1973 | Propach et al. | 72/212 |
| 3,983,733 | A * | 10/1976 | Davis | 72/213 |
| 5,709,118 | A * | 1/1998 | Ohkubo | 72/213 |
| 5,794,475 | A | 8/1998 | Schuppler et al. | |
| 5,829,297 | A * | 11/1998 | Ohkubo | 72/213 |
| 5,862,700 | A * | 1/1999 | Klein | 72/213 |
| 5,953,947 | A * | 9/1999 | Klein | 72/213 |
| 7,004,006 | B2 * | 2/2006 | Nagae | 72/450 |
| 7,540,179 | B2 * | 6/2009 | Schlayer et al. | 72/102 |
| 7,743,637 | B2 * | 6/2010 | Schlayer et al. | 72/213 |
| 2009/0090154 | A1 * | 4/2009 | Sandner | 29/893.32 |
| 2009/0126440 | A1 * | 5/2009 | Ziesel et al. | 72/213 |

OTHER PUBLICATIONS

International Search Report (Jan. 26, 2010, 2 pages).

* cited by examiner

*Primary Examiner* — Dana Ross
*Assistant Examiner* — Mohammad I Yusuf
(74) *Attorney, Agent, or Firm* — The Maxham Firm

(57) ABSTRACT

A method and a device for producing an internally or externally toothed cup-shaped (body) sheet material component with alternating teeth and grooves that run in parallel to the center axis of the cup, especially of a clutch plate carrier. The method and device allow the use of profile rollers, the rollers controlling the true running, dimensional accuracy and the surface of the cup-shaped sheet material component having an internally and externally profiled wall in the shape of teeth, in such a manner that they guarantee a specifically variable position during production. An untoothed cup-shaped sheet material component is slid onto a pick-up mandrel which has an external toothing corresponding to the internal toothing of the sheet material component to be produced and the external profile is then rolled onto the cup-shaped sheet material component by pressing the cup-shaped sheet material component together with the pick-up mandrel by means of a set of profile rollers while exerting a radial pressure.

16 Claims, 7 Drawing Sheets

METHOD FOR PRODUCING AN INTERNALLY OR EXTERNALLY TOOTHED CUP-SHAPED SHEET MATERIAL COMPONENT AND CORRESPONDING DEVICE

FIELD OF THE INVENTION

The invention embodiments disclosed relate generally to a method for producing an internally and externally toothed cup-shaped sheet material component with teeth that run in parallel to the center axis of the cup, in particular of a clutch plate carrier, and a corresponding device.

BACKGROUND

When manufacturing internally and externally toothed cup-shaped sheet material components, for example, cup-shaped clutch plate carriers or similar workpieces with a cylindrical basic structure, high accuracy and precision are required in their production. Particularly important is the accuracy of the true running while adhering to the cylindrical basic structure.

Thus, this involves high quality, cup-shaped sheet material components produced with a tooth-like shape on the inside and the outside which are primarily required in high numbers, also for automatic transmissions. Thus, in addition to quality features, low cost for producing the same is an important aspect for the concept of a production device for such sheet material components.

From German patent, DE 20 17 709, such a method for rolling longitudinal grooves into cylindrical workpieces is known, which method allows to form a wall profile of the sheet material component in a single operation by means of a press.

An adequately designed rolling tool can form a cup-shaped sheet material component (blank) in a single working stroke into an internally and externally tooth-like profiled finished profile. Here, with each press stroke, a rolling process on the sheet material component takes place, wherein a ring-shaped set of profile rollers rolls the desired external profile into the outside surface of the sheet material component.

For this, the set of profile rollers is positioned in the bottom tool of the device around the circumference of the sheet material component to be produced. The sheet material component is fastened in the upper tool by means of a pick-up mandrel. Upon actuation of the upper tool via the ram of the press, the cup-shaped sheet material component is pressed through between the set of rollers.

The profile rollers of the device itself have a relatively small diameter, wherein their axle pins are each supported toward the support ring side by two support rollers during the rolling process.

The support rollers are configured on top of each other in the vertical center plane of the respective profile roller but are inclined at an acute angle with respect to the horizontal, namely, for transferring the occurring rolling forces into the support ring.

Furthermore, the profile rollers can be individually radially preset toward the sheet material component or its pick-up mandrel, respectively, wherein this takes place at the respective receiving body by means of wedge pieces between the pair of support rollers and the outer support ring.

The profile rollers as well as each of their two support rollers are arranged in a single massive receiving body in such a manner that a relatively secure force transfer into the reinforcing ring can take place during the rolling process of longitudinal grooves into the cylindrical workpiece.

The receiving bodies for profile rollers and support rollers are arranged next to one another and spaced apart from one another thereby forming the ring-shaped set of profile rollers.

Thus, the bottom tool can be structured in a rotationally symmetric manner, wherein the profile rollers generating the profile of the sheet material component are regularly distributed and at a uniform angle to one another along the circumference of the sheet material component. Consequently and because of the resulting rotationally symmetric force distribution during the rolling process, the individual grooves produced by the respective profile rollers are virtually identical. In particular, a step-free contour is achieved.

A disadvantage of the method is that different sheet materials from different material batches can result in dimensional deviations with respect to the true running and on the surface. Furthermore, the adjustment of the tool to the specified dimension requires a significant amount of work and time during tool making or repair/maintenance.

SUMMARY OF EMBODIMENTS OF THE INVENTION

Embodiments of the invention are thus based on a purpose to provide a method and a device in which the profile rollers, which control the true running, the dimensional accuracy, and the surface of the cup-shaped sheet material component having an internally and externally profiled wall in the shape of teeth, ensure a specifically variable position during the production process.

A purpose of embodiments of the invention is achieved, on the one hand, by a method for producing an internally and externally toothed cup-shaped sheet material with teeth that run in parallel to the center axis of the cup, an example being a clutch plate carrier. In this method, an untoothed cup-shaped sheet material component is slid onto a pick-up mandrel which has an external toothing corresponding to the internal toothing to be produced of the sheet material component and the external profile is then rolled onto the cup-shaped sheet material component by pressing the cup-shaped sheet material component together with the pick-up mandrel through a set of profile rollers rolling in parallel to the center axis on the sheet material component while exerting a radial pressure, thereby pressing the material into the tooth grooves of the pick-up mandrel. By this means, in the region of the open end of the cup-shaped sheet material component to be formed, a displacement of each profile roller of the set of profile rollers toward the pick-up mandrel takes place, whereby the desired profile of the forming internally and externally toothed region at the open end of the sheet material component is generated due to a pressure relief. Removal of the sheet material component toothed in such a manner is then accomplished.

A purpose is further achieved by a device for producing an internally and externally cup-shaped sheet material component with teeth that run in parallel to the center axis of the cup, again, such as a clutch plate carrier. The device comprises a tool part with a circumferentially arranged set of profile rollers arranged concentric to the workpiece and have profile roller axes arranged transverse to the workpiece axis. A further tool part with a pick-up mandrel that has a tooth-like profiled outer contour for the sheet material component is also included, wherein the tool part with the set of profile rollers and the pick-up mandrel of the further tool part are formed to be coaxially movable with respect to one another.

Each profile roller is arranged in a floating manner in a split bearing shell in a substantially rectangularly formed profile roller holder.

Embodiments of the invention are based on the idea to use the downwardly directed stroke of a forming press for a roll forming process within a tool in which, depending on the contour of the component, a multi-dimensional rolling along a rotary outer contour is possible. By the rollers which are movable during the stroke, dimensional deviations can be corrected and a subsequent finish grinding for achieving the desired tolerance on the sheet material component is not required during the fabrication of the device. This applies in particular to high components which, for example, in case of transmission parts, must be provided with the same highly speed-resistant shape as sheet material components with a low component height. Due to anisotropic properties of the sheet material, a critical ratio of component height to sheet material thickness can result in undesired, widened, that is, non-homogeneous, dimensional tolerance with respect to the workpiece diameter (tulip shape). Here, it is necessary to arrange the rollers according to calculated and incorporated contours during the forming not in a stationary manner with respect to the circumference of the sheet material component, but movable/adjustable so as to counteract this effect. A negative form of the pick-up mandrel for the sheet material component is to be considered here.

A method according to embodiments of the invention is thus based on the idea that an untoothed cup-shaped sheet material component is slid onto a pick-up mandrel which has an external toothing corresponding to the internal toothing to be produced of the sheet material component, and the external profile is then rolled onto the cup-shaped sheet material component by pressing the cup-shaped sheet material component together with the pick-up mandrel through a set of profile rollers rolling in parallel to the center axis on the sheet material component while exerting a radial pressure, thereby pressing the material into the tooth grooves of the pick-up mandrel.

According to embodiments of the invention, the method described above is completed in such a manner that in the region of the open end of the cup-shaped sheet material component to be formed, a displacement of each profile roller of the set of profile rollers toward the pick-up mandrel takes place, whereby the desired profile of the forming internally and externally toothed region at the open end of the sheet material component is generated due to a pressure relief and removal of the sheet material component toothed in such a manner.

An advantageous configuration of the described method is considered that toward the end of the tooth rolling process, each profile roller of the profile roller set is displaced during the tooth forming in radial direction in the range of 0.01 to 4 millimeters corresponding to the negative form of the mandrel.

The device for carrying out the method according to the invention embodiments is configured in such a manner that a tool part comprises a circumferentially arranged set of profile rollers, the profile rollers of which are arranged concentric to the sheet material component and have profile roller axes arranged transverse to the workpiece axis. Further, the tool part has a pick-up mandrel with a tooth-like profiled outer contour for the sheet material component, and the tool part having the set of profile rollers and the pick-up mandrel of the other tool part are formed to be coaxially movable with respect to one another. This basic design of the device is configured according to the invention in such a manner that each profile roller is arranged in a floating manner in a split bearing shell in a substantially rectangularly formed profile roller holder.

According to a preferred embodiment of the invention, a common wedge-shaped guide part can be provided between the profile roller holders and toward the holding ring, each profile roller holder can be configured to be radially adjustable by means of a wedge element in the direction toward the sheet material component to be formed.

As developments of the device are considered that a control of the wedge elements for radial adjustability in the direction of the sheet material component to be formed as well as the withdrawal of the same by ram elements arranged at the upper tool is provided.

A control of the wedge elements for radial adjustability in the direction toward the sheet material component to be formed can also be provided by means of servo-electric drives and depending on the stroke position. On the other hand, the radial adjustability can also be provided servo-hydraulically, depending on the stroke position and freely programmable.

In the above described embodiments of the device according to the invention it is particularly useful if by means of a pressurized lubrication, lubricant can be fed via a lubricant line to the profile rollers.

Moreover, it is of advantage in said variants if by means of a pressurized lubrication, lubricant for the respective adjusting mechanism can be fed via a lubricant line.

According to a further variant, the device according to the invention is configured in such a manner that each profile roller is configured to be movable in the direction toward the sheet material component to be formed.

In a further advantageous development of the invention, the profile rollers are configured to be movable during the downstroke of the ram in the radial direction toward the sheet material component to be formed and can be moved back in the starting position by means of an ejector or cushion/drawing mechanism of the press after/upon end of the stroke.

According to a further exemplary embodiment of the device according to the invention, each profile roller holder is formed as one piece.

According to a further variant of the invention, a plurality of devices according to the invention can be arranged one above the other.

BRIEF DESCRIPTION OF THE DRAWING

The invention is further described below by means of the subsequent detailed description of advantageous embodiments of the invention, reference being made to the accompanying drawing, wherein.

DETAILED DESCRIPTION OF EMBODIMENTS OF THE INVENTION

Figure 1:
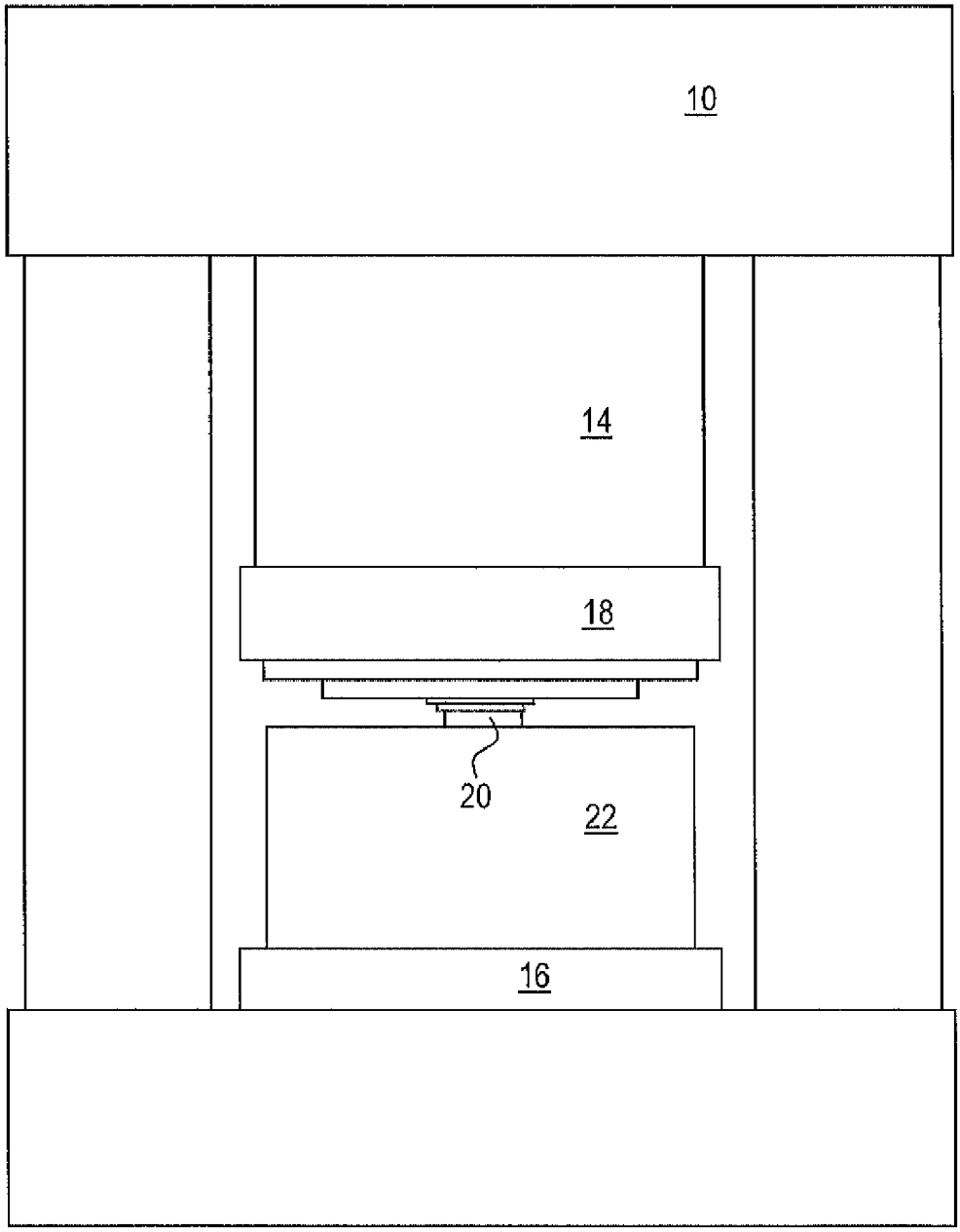
FIG. 1 is a schematic illustration of a press with a device for producing an internally and externally toothed cup-shaped sheet material component in a front view.
Figure 2:
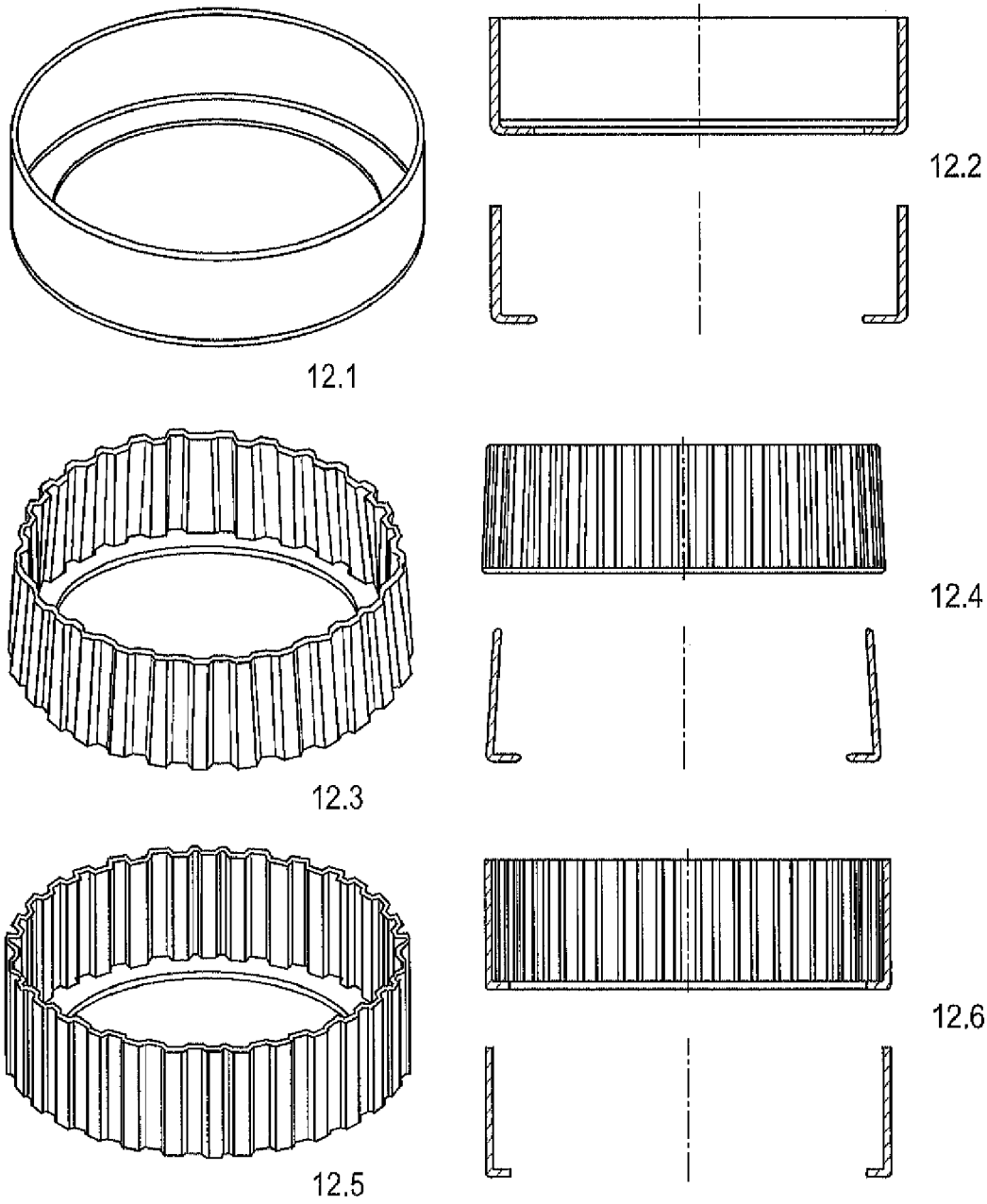
FIG. 2 shows on the left side from top to bottom, isometric views from the raw cup-shaped sheet material component to the toothed finished part, and on the right side from top to bottom, the respective associated profile and sectional views.

With reference now to the drawing, and more particularly to FIG. 1, there is shown press 10 which can be used for producing an internally and externally toothed sheet material workpiece or sheet material component 12.1 to 12.6 according to FIG. 2. Press 10 has ram 14 and stationary table 16 (press drive and tie rod are not described in detail). Between ram 14 and table 16, a device is arranged which carries tool part 18 with partially visible pick-up mandrel 20 for sheet material component 12.1 to 12.6 to be toothed (not shown in FIG. 1) and, furthermore, tool part 22 which includes a circumferentially arranged set 24 of profile rollers (shown in FIG. 3 and not shown in FIG. 1). Principally, when loaded with a starting component 12.1/12.2, press 10 delivers a finished component 12.5/12.6 with each working stroke.

For the sake of clarity, FIG. 2 shows operating sequences of the process from raw sheet material component 12.1/12.2 to toothed sheet material component 12.5/12.6. Raw cup-shaped sheet material component 12.1 is shown in isometric view as well as in sectional and profile views 12.2. The end of the roll forming process shows the isometric, internally and externally toothed view of sheet material component 12.3 including the corresponding sectional and profile views 12.4.

It is intended to show here how the process of a controlled roll forming of the tooth-like profile radially toward the forming profile is carried out to counteract, for example, a so-called tulip shape toward the outside by a deformation through roll forming as shown. The isometric view of finished toothed sheet material component 12.5 occurs after pressure relief and removal of the finished part. Thus, the required target profile of the toothed sheet material component is achieved. Corresponding sectional and profile views are shown by means of ejected finished toothed sheet material component 12.6.

Figure 3:
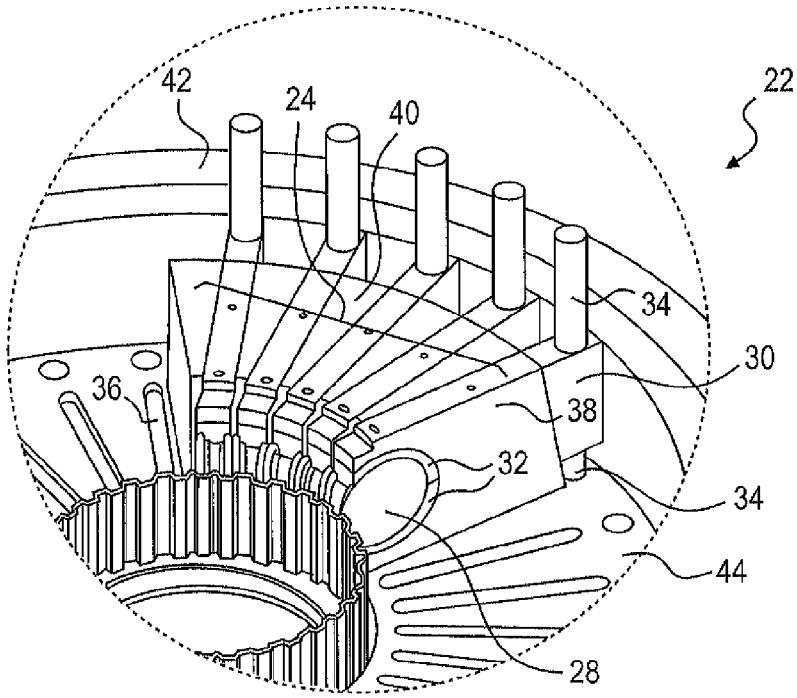
FIG. 3 shows a cut-out of an isometric partial view of a tool part for producing internally and externally toothed cup-shaped sheet material components without cover plate and pick-up mandrel or ejector mechanism, with profile roller holder, profile roller, split bearing bush, guide wedges, holding ring and wedge elements with adjusting elements for radial displacement during the forming process.

FIG. 3 shows a cut-out of an isometric partial view of the device, namely, a portion of tool part 22 with a set 24 of profile rollers with cover plate 26 (FIG. 5) removed. Profile roller holders 38 containing profile rollers 28 positioned on the front side and each floating in split bearing bushes 32 are arranged ring-like on base plate 44. An adequate pressure lubrication for this arrangement of profile rollers 28 is shown in FIGS. 5 to 8. Between each of profile roller holders 38, stationary guide wedges 40 are arranged. All profile roller holders 38 are mounted on base plate 44 in guiding grooves 36 and are individually movable for the purpose of radial guidance. Behind each profile roller holder 38 toward holding ring 42, vertically movable wedge elements 30 are placed which are subjected via adjusting elements 34 during the rolling process to their radial displacement for the purpose of forming the desired toothing on the cup-shaped sheet material component 12.1 to 12.6.

Figure 4:
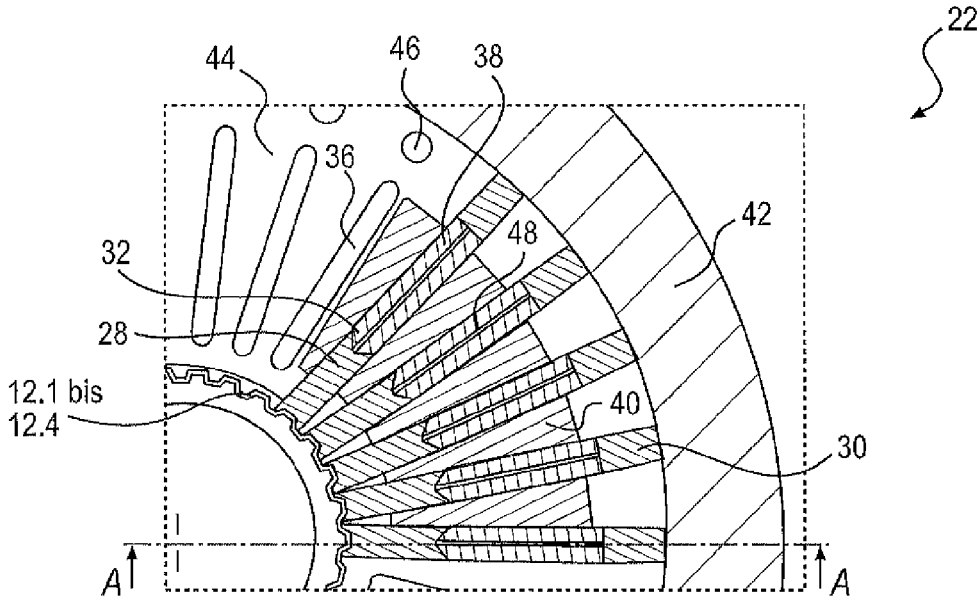
FIG. 4 is a schematic top view of the cross-section through the center of the tool according to FIG. 3.

FIG. 4 is a schematic top view of the cross-section through the center of tool part 22 shown in FIG. 3. This illustration is principally meant to complement the FIG. 3 representation of tool part 22. This is provided in order to disassemble the relatively simple tool structure of arrangement and configuration of profile roller holders 38 with profile rollers 28 in bearing bushes 32, guide wedges 40 which are stationarily arranged between profile roller holders 38, and wedge elements 30 which are provided behind each profile roller holder 38 and are supported on holding ring 42. The cup-shaped tool part 12.1 to 12.4 to be formed assumes the central middle position on the left side of FIG. 4 when FIG. 4 is shown as a completed figure. Around the sheet material component 12.1 to 12.4, set 24 of profile rollers, which is illustrated in FIG. 3, is arranged, wherein individual profile roller holders 38, which each are guided in guiding grooves 36, allow a controlled displacement in the radial direction during the roll forming process via wedge elements 30 with their vertical adjustment possibilities through adjusting elements 34.

Thus, a previous disadvantage of the prior art, namely the formation of a so-called tulip shape on internally and externally toothed cup-shaped sheet material components, can be specifically excluded. Furthermore, the true running and the surface quality can be positively influenced by a specific control of the radial displacement.

Figure 5:
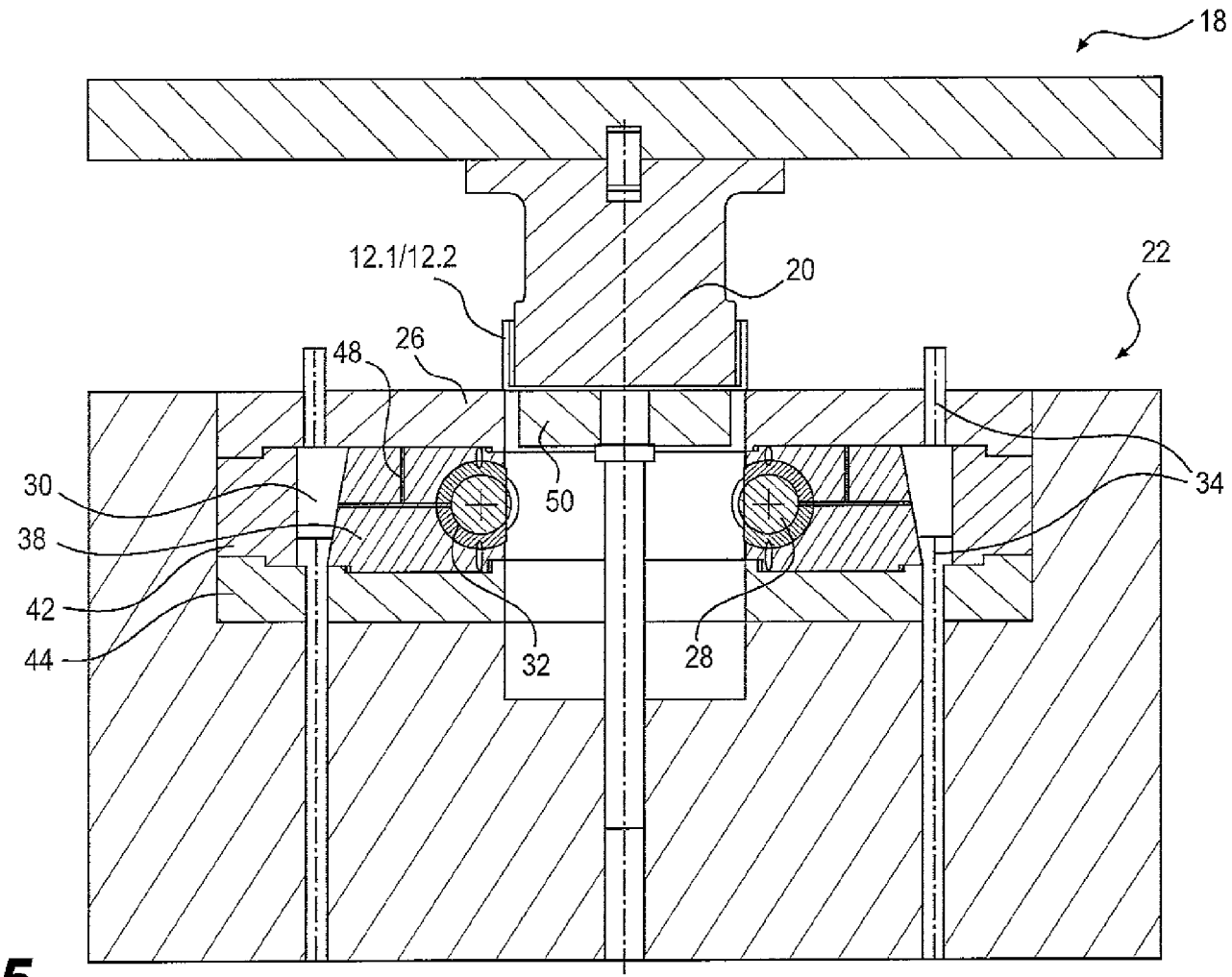
FIG. 5 is a sectional view A-A according to FIG. 4 through an entire roller plane with a cup-shaped sheet material component in starting position.

FIG. 5 to FIG. 8 show a process sequence for producing an internally and externally cup-shaped sheet material component with teeth that run in parallel to the center plane of the cup, wherein the control of wedge elements 30 via adjusting elements 34 is shown only as principle. The starting position of the roll forming process is shown in FIG. 5.

The tool part 18 with pick-up mandrel 20 for the cup-shaped sheet material component 12.1/12.2 is fastened on the ram of press 14 (FIG. 1). Accordingly, tool part 22 with set 24 of profile rollers consisting of profile roller holders 38 with profile rollers 28 in bearing bushes 32 including wedge elements 30 arranged in holding ring 42 is anchored between cover plate 26 and base plate 44 on press table 16.

Figure 6:
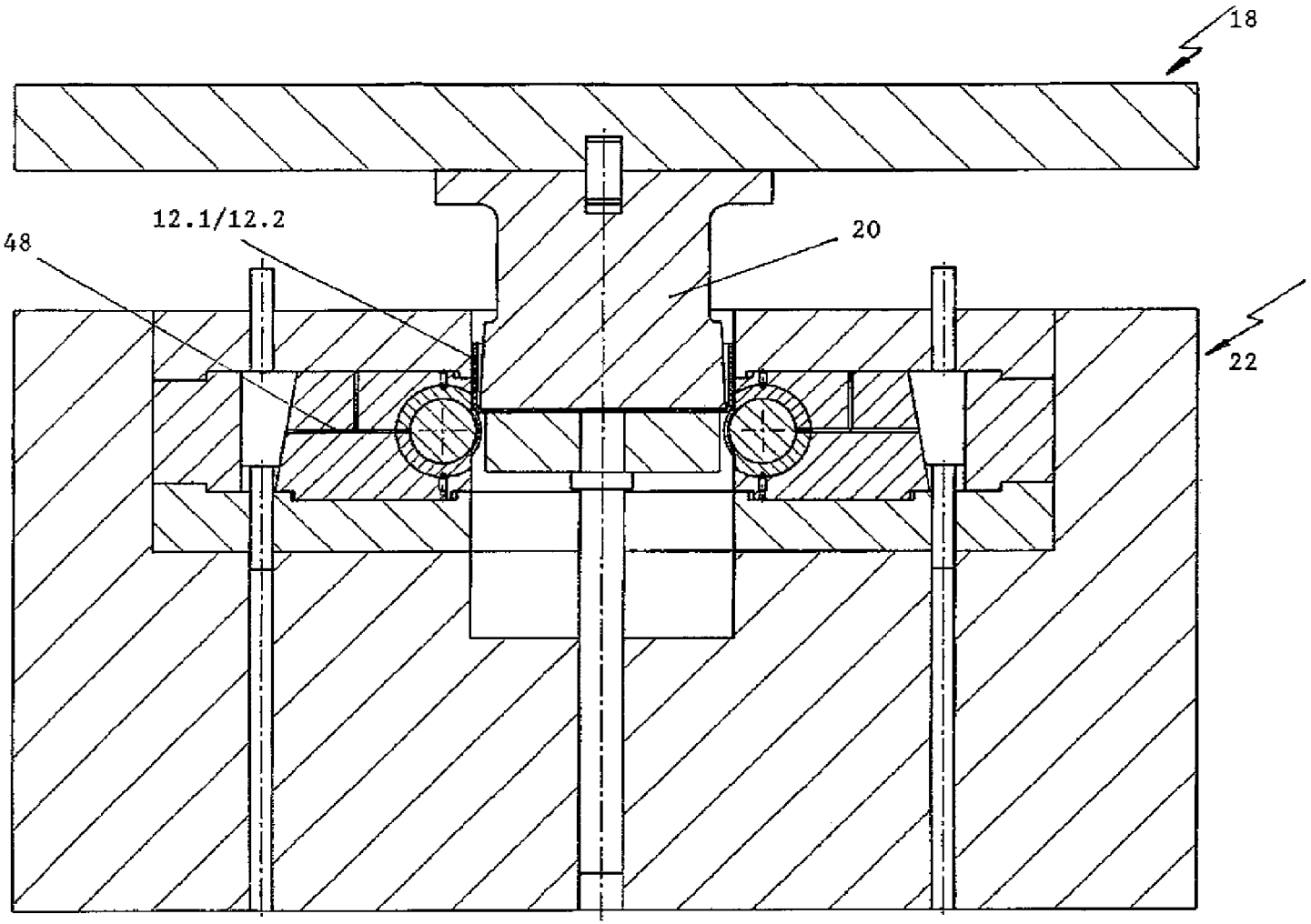
FIG. 6 shows a sectional view according to FIG. 5 at the beginning of the tooth forming process.

In FIG. 6 the beginning of the roll forming process of the outer region of the cup-shaped raw sheet material component 12.1/12.2 is shown. The required negative form of the pick-up mandrel 20 for the workpiece is illustrated in a clear manner.

Figure 7:
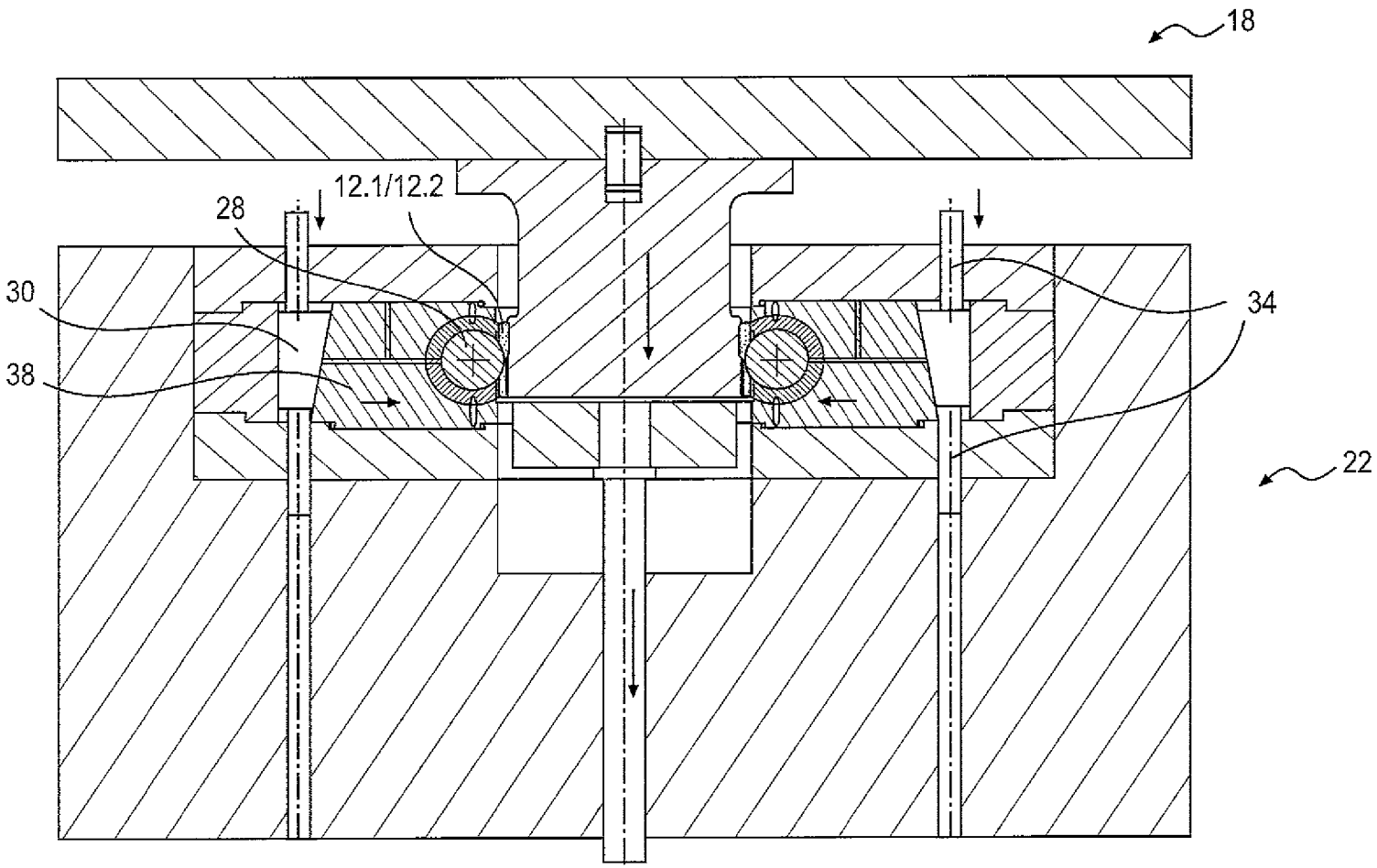
FIG. 7 is a fluffier sectional view according to FIG. 6 during the tooth forming process on the cup-shaped sheet material component, wherein a radial displacement of the profile roller holder in the direction of the tooth formation is shown.

In FIG. 7, approximately half of the forming process of the internally and externally toothed cup-shaped sheet material component 12.3/12.4 by roll forming is already carried out by the downstroke of the ram which moves tool part 18 with pick-up mandrel 20 in the direction shown by the arrow. Profile rollers 28, which are floatingly mounted in profile roller holder 38, perform the desired tooth forming according to the controlled vertical movements of wedge elements 30 which generate radial travel components of profile roller holder 38 in each case toward the sheet material component 12.1/12.2 or 12.3/12.4, respectively, to be formed. The controlled movements of wedge elements 30 arranged in a ring-like manner are indicated by arrow illustrations near adjusting elements 34.

Figure 8:
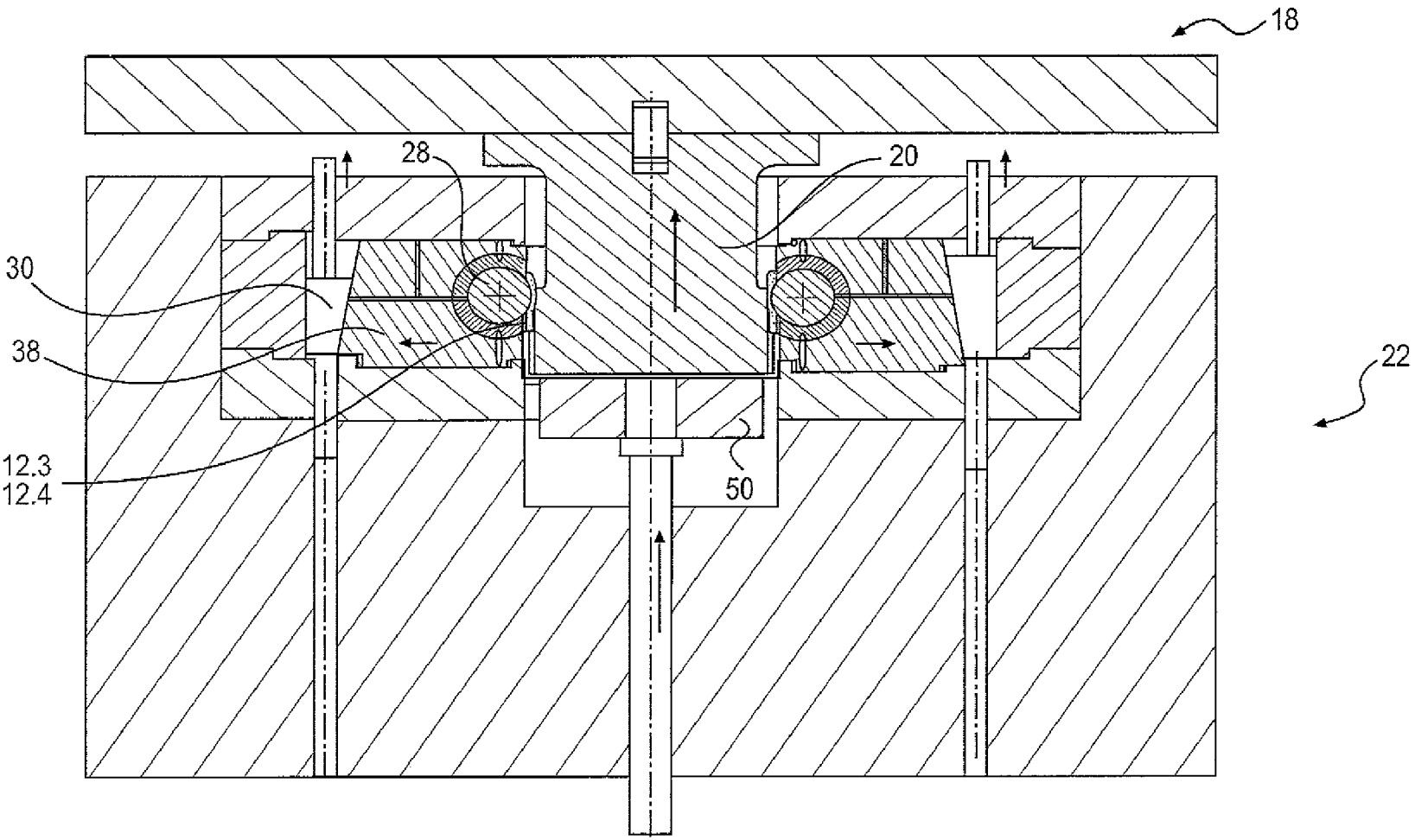
FIG. 8 is a section according to FIGS. 5 to 7 through the roller plane at the end of the tooth forming process of the sheet material component, wherein the radial displacement of the profile roller holder is completed and the desired profile of the teeth is finally formed upon ejection of the finished toothed sheet material component out of the device.

The end of the roll forming process of the toothing of the cup-shaped sheet material results in component 12.3/12.4 or 12.5/12.6, respectively (FIG. 2), is finally illustrated in FIG. 8. As already mentioned in FIGS. 5, 6 and 7, the radial displacements of profile roller holders 38 with corresponding forming profile rollers 28 toward pick-up mandrel 20 with the sheet material component to be formed arranged therebetween are performed. The only thing left to do is to retract tool part 18 with pick-up mandrel 20 with involvement of counter support/ejector 50 to remove the finished toothed sheet material component 12.3/12.4 or 12.5/12.6, respectively, from the region of the entire device, wherein finally, due to the occurring pressure relief, the desired target dimension of the toothing of the finished sheet material component is generated.

What is claimed is:

1. A method for producing an internally and externally toothed cup-shaped component from an untoothed cup-shaped sheet material component, the untoothed cup-shaped component having a center axis and the resulting toothed cup-shaped component having teeth that run parallel to the center axis of the cup-shaped component, the method comprising:

sliding the untoothed cup-shaped sheet material component onto a pick-up mandrel formed with external alternating teeth and grooves corresponding to teeth and grooves to be produced on the cup-shaped sheet material component, the pick-up mandrel being mounted to a linearly movable ram element;

rolling an external profile onto the cup-shaped sheet material component by pressing the cup-shaped sheet material component together with the pick-up mandrel through a set of profile rollers rolling in parallel to the center axis of the cup-shaped sheet material component while exerting a radial pressure, thereby pressing the material into the grooves of the pick-up mandrel;

during the rolling step, displacing each profile roller of the set of profile rollers toward the pick-up mandrel, the relative motion of the profile rollers and the pick-up mandrel being toward an open end of the cup-shaped sheet material component;

controlling radial displacement of each profile roller of the set of profile rollers by means of adjusting elements during the rolling step;

thereby generating the toothed cup-shaped component due to a pressure relief; and removing the thereby cup-shaped toothed component from the mandrel.

2. The method according to claim 1, wherein toward the end of the rolling step, each profile roller of the set of profile rollers is displaced during the tooth forming in the radial direction in the range of 0.01 to 4 millimeters corresponding to the negative form of the mandrel.

3. The method according to claim 1, and further comprising after completed forming of the cup-shaped component:

retracting a tool part with the pick-up mandrel by means of a counter support/ejector to accomplish the removing step.

4. The method according to claim 2, and further comprising after completed forming of the cup-shaped component:

retracting a tool part with the pick-up mandrel by means of a counter support/ejector to accomplish the removing step.

5. A device for producing from an untoothed cup-shaped sheet material component having a center axis an internally and externally toothed cup-shaped component, by a roll forming process the device comprising:

a pick-up mandrel formed with external alternating teeth and grooves corresponding to the internal toothing to be produced in the untoothed cup-shaped sheet material component, the mandrel being mounted on a linearly movable ram element and being configured to receive the cup-shaped sheet material component thereon;

a set of profile rollers arranged during the roll forming process for rolling in parallel to the center axis on the cup-shaped sheet material component while exerting a radial pressure to thereby press the material into the grooves of the pick-up mandrel, whereby the external toothed profile is formed onto the cup-shaped component;

a substantially rectangularly formed profile roller holder coupled to each profile roller of the set of profile rollers;

a split bearing shell in which each profile roller is arranged in a floating manner for the controlled displacement of each profile roller in the radial direction;

means for displacing each profile roller of the set of profile rollers toward the pick-up mandrel;

a holding ring;

vertically movable wedge elements between each profile roller holder and the holding ring;

an adjusting element coupled to each vertically movable wedge element and arranged for moving the wedge elements to cause a radial displacement of each profile roller holder during the roll forming process for the purpose of forming the desired toothing of the cup-shaped component, each of the adjusting elements being configured for control of a wedge element for radial adjustability in the direction toward the cup-shaped component to be formed as well as retraction away from the cup-shaped component; and means for providing a controlled displacement of the set of rollers in the radial direction during the roll forming process, whereby the desired profile of the internally and externally toothed region at the open end of the sheet material component is generated due to a pressure relief and removal of the sheet material component.

6. The device according to claim 5, and further comprising:

stationary guide wedges arranged between each of the profile roller holders; and a base plate having guiding grooves in which the profile roller holders are mounted for limited individual radial movability.

7. The device according to claim 5, and further comprising:

a common wedge-shaped guide part positioned between each of the profile roller holders;

each profile roller holder being configured to be radially adjustable by means of the respective wedge element in the direction toward the cup-shaped component to be formed.

8. The device according to claim 7, and further comprising:

an ejector or cushion/drawing mechanism;

whereby each profile roller is configured to be movable in the radial direction toward the cup-shaped component to be formed during the downstroke of the ram element and can be moved back in a starting position by means of the ejector of the press after or upon end of the stroke.

9. The device according to claim 7, and further comprising:

servo-electric drives;

control of the wedge elements for radial adjustability in the direction of the cup-shaped component to be formed is provided by means of the servo-electric drives, depending on the stroke position.

10. The device according to claim 8, and further comprising:

servo-electric drives;

control of the wedge elements for radial adjustability in the direction of the cup-shaped component to be formed is provided by means of the servo-electric drives, depending on the stroke position.

11. The device according to claim 5, wherein each profile roller holder is formed as one piece.

12. The device according to claim 5, and further comprising a lubricant line to the profile rollers to provide pressurized lubrication to the profile rollers.

13. The device according to claim 5, and further comprising a lubricant line to provide pressurized lubrication to the respective adjusting mechanism.

14. The device according to claim 5, wherein a plurality of device arrangements are provided arranged one above the other.

15. A method for producing an internally and externally toothed cup-shaped component from an untoothed cup-shaped sheet material component, the untoothed cup-shaped component having a center axis and the resulting toothed cup-shaped component having teeth that run parallel to the center axis of the cup-shaped component, the method comprising:

sliding the untoothed cup-shaped sheet material component onto a pick-up mandrel formed with external alternating teeth and grooves corresponding to teeth and grooves to be produced on the cup-shaped sheet material component, the pick-up mandrel being mounted to a linearly movable ram element;

rolling an external profile onto the cup-shaped sheet material component by pressing the cup-shaped sheet material component together with the pick-up mandrel through a set of profile rollers rolling in parallel to the center axis of the cup-shaped sheet material component while exerting a radial pressure, thereby pressing the material into the grooves of the pick-up mandrel;

during the rolling step, displacing each profile roller of the set of profile rollers toward the pick-up mandrel, the relative motion of the profile rollers and the pick-up mandrel being toward an open end of the cup-shaped sheet material component;

controlling radial displacement of each profile roller of the set of profile rollers by means of adjusting elements during the rolling step wherein toward the end of the rolling step, each profile roller of the set of profile rollers is displaced during the tooth forming in the radial direction in the range of 0.01 to 4 millimeters corresponding to the negative form of the mandrel;

thereby generating the toothed cup-shaped component due to a pressure relief; and removing the thereby cup-shaped toothed component from the mandrel.

16. A device for producing from an untoothed cup-shaped sheet material component having a center axis an internally and externally toothed cup-shaped component by a roll forming process, the device comprising:

a pick-up mandrel formed with external alternating teeth and grooves corresponding to the internal toothing to be produced in the untoothed cup-shaped sheet material component, the mandrel being mounted on a linearly movable ram element and being configured to receive the cup-shaped sheet material component thereon;

a set of profile rollers arranged during the roll forming process for rolling in parallel to the center axis on the sheet material component while exerting a radial pressure to thereby press the material into the tooth grooves of the pick-up mandrel, whereby the external profile is formed onto the cup-shaped body material component, each profile roller being formed with spaced fingers extending radially toward the mandrel and toward the center of the cup-shaped body, each finger engaging a different groove on either side of a ridge of the cup-shaped body, adjacent fingers of adjacent profile rollers residing in a common groove in the cup-shaped body;

a substantially rectangularly formed profile roller holder coupled to each profile roller of the set of profile rollers;

a split bearing shell in which each profile roller is arranged in a floating manner for the controlled displacement of each profile roller in the radial direction;

means for displacing each profile roller of the set of profile rollers toward the pick-up mandrel;

a holding ring;

vertically movable wedge elements between each profile roller holder and the holding ring;

an adjusting element coupled to each vertically movable wedge element and arranged for moving the wedge elements to cause a radial displacement of each profile roller holder during the roll forming process for the purpose of forming the desired toothing of the cup-shaped component, each of the adjusting elements being configured for control of a wedge element for radial adjustability in the direction toward the cup-shaped component to be formed as well as retraction away from the cup-shaped component; and means for providing a controlled displacement of the set of rollers in the radial direction during the roll forming process, whereby the desired profile of the internally and externally toothed region at the open end of the sheet material component is generated due to a pressure relief and removal of the sheet material component.

* * * * *